US006352651B1

(12) United States Patent
Endo et al.

(10) Patent No.: US 6,352,651 B1
(45) Date of Patent: Mar. 5, 2002

(54) ELECTRORHEOLOGICAL FLUID

(75) Inventors: Shigeki Endo, Tokorozawa; Hiroaki Wada, Kawasaki, both of (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/323,915

(22) Filed: Jun. 2, 1999

(30) Foreign Application Priority Data

Jun. 8, 1998 (JP) ..... 10-159732
Jun. 8, 1998 (JP) ..... 10-159733

(51) Int. Cl.[7] ..... C09K 5/00
(52) U.S. Cl. ..... 252/74; 252/73; 252/71
(58) Field of Search ..... 252/74, 73, 71

(56) References Cited

U.S. PATENT DOCUMENTS 5,252,249 A * 10/1993 Kurachi et al. ..... 252/71
5,429,761 A * 7/1995 Havelka et al. ..... 252/74
5,435,932 A * 7/1995 Bryant et al. ..... 252/77

FOREIGN PATENT DOCUMENTS

| | | |
|---|---|---|
| EP | 0 311 984 | 10/1988 |
| EP | 0 445 594 A1 | 2/1991 |
| JP | B 35-8345 | 4/1958 |
| JP | B 47-47880 | 12/1972 |
| JP | A 53-93186 | 8/1978 |
| JP | B 60-31211 | 7/1985 |
| JP | A 61-216202 | 9/1986 |
| JP | A 62-95397 | 5/1987 |
| JP | A 63-97694 | 4/1988 |
| JP | A 1-164823 | 6/1989 |
| JP | 02-255798 | 1/1991 |
| JP | A 7-90287 | 4/1995 |
| JP | 08-143886 | 6/1996 |
| JP | 08-157850 | 6/1996 |
| JP | A-8-176584 | 7/1996 |
| JP | A 10-81889 | 3/1998 |

OTHER PUBLICATIONS

W. M. Winslow, Induced Fibration of Suspensions, Feb. 23, 1949, pp. 1137–1140, Applied Physics vol. 20.
Abstract of JP10 0818889 A. Nov. 9, 1991.
Abstract of JP 05 112793 A. May 7, 1993 Japan.

* cited by examiner

*Primary Examiner*—Yogendra N. Gupta
*Assistant Examiner*—D. Hamlin
(74) *Attorney, Agent, or Firm*—Oliff & Berridge, PLC

(57) ABSTRACT

The present invention discloses an electrorheological fluid comprising: spherical carbonaceous particles obtained substantially from a solvent and a condensation product formed by a methylene type bonding of an aromatic sulfonic acid or a salt thereof as materials; and an, electric insulating oil. The electric insulating oil preferably has a relative dielectric constant of 3 or more and a kinematic viscosity at 25° C. of 1 to 100 $mm^2$/second. The electric insulating oil may be, for example, fluorosilicone oil, a mixture of fluorosilicone oil and silicone oil, or a mixture of dimethyl silicone oil and modified silicone oil. The electrorheological fluid of the present invention may further include modified silicone oil at a weight percentage of 0.01 to 5%. The electrorheological fluid of the present invention can be formed so as to have a dielectric breakdown strength of a predetermined value or more due to a production process in which the spherical carbonaceous particles and the electric insulating oil are mixed under a reduced pressure or a production process in which the spherical carbonaceous particles and the electric insulating oil are mixed under a normal pressure and thereafter, air or the like is removed from an obtained electrorheological fluid under a reduced pressure. The electrorheological fluid of the present invention preferably has a dielectric breakdown strength of 4.0 kV/mm or more.

11 Claims, No Drawings

ELECTRORHEOLOGICAL FLUID

BACKGROUND OF THE INVENTION

1. Field of the Invention

The present invention relates to an electrorheological fluid which can be used by high performance electrorheological (ER) devices, such as a damper, a clutch or the like used in cars, a large-size apparatus, guns or the like and which has a high electrorheological effect (yield stress).

2. Description of the Related Art

Electrorheological fluids are those of which viscoelasticity characteristics can be changed significantly and reversibly under electric control. The phenomenon that an apparent viscosity of the fluid greatly changes due to application of an electric field has been long known as the Winslow effect and the application of this effect for electrically controlling devices or parts, for example, clutches, valves, engine mounts, actuators, and robot arms, has been discussed. However, initially, electrorheological fluids were obtained by dispersing powder particles such as starch in mineral oil or in lubricating oil, and therefore, although these fluids can provide electrorheological effects, they each have drawbacks of poor recoverability.

It should be noted that herein the term "recoverability" means an ability to recover the original state (viscosity) after experiencing a change in viscosity due to application of an electric field.

For this reason, there have been made many proposals mainly on powder particles used as a dispersoid for the purpose of obtaining a fluid having a high electrorheological effect and good recoverability. For example, Japanese Patent Application Laid-Open (JP-A) No. 53-93186 discloses a highly water-absorbent resin having an acidic group such as polyacrylic acid. Japanese Patent Publication (JP-B) No. 60-31211 discloses an ion exchange resin, and Japanese Patent Application Laid-Open (JP-A) No. 62-95397 discloses aluminosilicate. These substances are hydrophilic solid particles. They are made to soak up water and dispersed in an insulating oily medium. It is said that, when a high voltage is applied from the outside, polarization occurs in the particles forming the powder particles due to the action of water, and the viscosity increases due to the crosslinking in the direction of an electric field generated between the particles by the polarization.

However, the above-described water-containing type electrorheological fluids using water-containing powder particles have many problems such as inability to produce a sufficient electrorheological effect in a wide range of temperatures, restrictions on a working temperature set to prevent occurrence of evaporation or freezing of water, increase in the quantity of electric current consumed due to the temperature rising, instability caused by transfer of water, corrosion of electrode metal during the application of high voltage, and the like. As a result, putting these fluids to practical use has been difficult.

In order to solve the above-described problems, there have been proposed un-hydrous electrorhelogical fluids without water-containing powder particles. For example, Japanese Patent Application Laid-Open (JP-A) No. 61-216202 discloses organic semiconductor particles such as polyacene quinone. Japanese Patent Application Laid-Open (JP-A) Nos. 63-97694 and 1-164823 each disclose dielectric particles obtained by applying an electroconductive thin film on the surface of organic or inorganic solid particles and further applying an electrically insulating thin film thereon (that is, each disclose thin film-coated type composite particles which necessarily include thin coating films having electrically conducting/insulating characteristics). Further, there have been known, as dispersoid particles of which electric characteristics are controlled, surface-treated metallic particles, metal-coated inorganic powder particles, and the like. However, all of these non-aqueous electrorheological fluids using powder particles cannot obtain a sufficient electroviscous effect at a low electric power consumption and also have various problems such as difficulty in industrial production, limited functional effectivity achieved only in an alternating electric field, and the like. Accordingly, these non-aqueous electroviscous fluids have not yet been put to practical use.

In order to further improve the electrorheological effects in non-aqueous electrorheological fluids at a low electric power consumption, it is necessary to increase the adding ratio of dispersoid powder. However, the initial viscosity of the fluid increases when raising the adding ratio of the powder, thereby resulting in the poorer electrorheological effect during the application of electric current.

In order to solve this problem, an electrorheological fluid using carbonaceous particles having a spherical structure has been proposed in Japanese Patent Application Laid-Open (JP-A) No. 7-90287. As described therein, it is advantageous to use carbonaceous particles having a homogeneous and spherical structure as the powder for the electrorheological fluid. However, when the electrorheological fluid is applied to each of a damper, a clutch, and the like, the particles are destroyed due to vibration or load of shearing stress and viscosity when an electric field is not applied thereby increases. Namely, insufficient durability resulting from the strength of the particles was a problem.

The present inventors have diligently researched to eliminate the above-described drawbacks and have already found an electrorheological fluid using carbonaceous particles having a spherical structure (which may hereinafter referred to merely as "spherical carbonaceous particles") which are obtained substantially from a solvent and a condensation product made by a methylene type bonding of an aromatic sulfonic acid or of a salt thereof (see Japanese Patent Application Laid-Open (JP-A) No. 10-81889).

This electrorheological fluid shows a high electrorheological effect at a low electric power consumption in a wide range of temperatures and under application of voltage, has high strength so as to make it difficult for powder particles to be destroyed due to a load of stress, and also has excellent durability.

However, when an electrorheological fluid is applied to high performance electrorheological (ER) devices such as a shock absorber used in a damper, a clutch or the like used in cars, a large-size apparatus, guns or the like, it is always necessary that the above-described spherical carbonaceous particles show a higher electrorheological effect under application of voltage than that currently observed. In other words, when ordinary silicone oil is used as a dispersion medium for the above-described electrorheological fluid, a sufficient electrorheological effect (yield stress) cannot be obtained under application of voltage.

SUMMARY OF THE INVENTION

An object of the present invention is to provide an electrorheological fluid which has a higher electrorheological effect (yield stress) under the application of voltage and which can be used stably (that is, dielectric breakdown strength thereof is maintained at a high value).

In order to solve the above-described problems, the present invention has the following aspects.

According to a first aspect of the present invention, there is provided an electrorheological fluid which comprises: carbonaceous particles of a spherical form, obtained substantially from a solvent and a condensation product formed by a methylene type bonding of an aromatic sulfonic acid or a salt of the aromatic sulfonic acid as materials; and an electric insulating oil whose relative dielectric constant is 3 or more.

According to a second aspect of the present invention, the spherical form has a deviation of the maximum diameter and a deviation of the minimum diameter of the carbonaceous particles each within 30% of the average diameter, and the average particle size of the carbonaceous particles is of 0.1 to 20 $\mu$m.

According to a third aspect of the present invention, the electric insulating oil whose relative dielectric constant is 3 or more is any one of fluorosilicone oil and a mixture of fluorosilicone oil and silicone oil, and has a kinematic viscosity at 25° C. of 1 to 100 $mm^2$/second.

According to a fourth aspect of the present invention, the fluorosilicone oil is an electric insulating oil comprised of a siloxane polymer including 0 to 90 mol % of dimethylsiloxane units and 10 to 100 mol % of fluoroalkylmethylsiloxane units.

According to a fifth aspect of the present invention, the above-described electrorheological fluid may further comprises modified silicone oil at a weight percentage of 0.01 to 5%.

According to a sixth aspect of the present invention, the modified silicone oil is one or more modified silicone oils selected from a group consisting of an amino-modified silicone oil, a polyether-modified silicone oil, a fluorine-modified silicone oil, an alkoxy-modified silicone oil, and an epoxy-modified silicone oil, or is a composite modified silicone oil, the composite modified silicone oil being a modified silicone oil having two or more groups selected from a group consisting of the amino group, the polyether group, the fluorine group, the alkoxy group, and the epoxy group.

According to a seventh aspect of the present invention, a dielectric breakdown strength of the electrorheological fluid is 4.0 kV/mm or more.

According to an eighth aspect of the present invention, the above-described electrorheological fluid has a yield stress of 3.2 kPa or more when a voltage of 4 kV/mm is applied thereto.

According to a ninth aspect of the present invention, the above-described electrorheological fluid causes no bubble in a reduced-pressure atmosphere of 10 Pa.

DESCRIPTION OF THE PREFERRED EMBODIMENTS

A description will hereinafter be given of a preferred embodiment of an electrorheological fluid according to the present invention.

The present embodiment is based on the discovery that a relative dielectric constant of an electric insulating oil as a dispersion medium has a great influence on the electrorheological effect of the fluid, and particularly, with the relative dielectric constant being set at three or more, a high electrorheological effect can be obtained irrespective of the kind of dispersion medium.

The reason why the relative dielectric constant of the electric insulating oil has an influence on the electrorheological effect as described above is not clearly known. When an electric insulating oil having a large relative dielectric constant is used, polarization of particles (dispersion medium) is probably intensified under the application of voltage, and as a result, a strong structure may be formed so as to increase resistance to shear.

Further, the present embodiment is characterized in that degassing treatment is carried out with modified silicone oil being added to a mixture of spherical carbonaceous particles used as a dispersoid, and electric insulating oil used as a dispersion medium. As a result, an electrorheological fluid having a higher electrorheological effect and higher dielectric breakdown strength can be obtained.

The electrorheological effect of the electrorheological fluid is improved with a modified silicone oil being added to the electrorheological fluid probably because dispersion of dispersoid (powder particles) is improved due to the addition of the modified silicone oil and the viscosity with no electric field sharply decreases. Further, carrying out degassing treatment improves the dielectric breakdown strength probably because the treatment allows removal of air dissolved into the electrorheological fluid during the mixing procedure.

The electrorheological fluid of the present embodiment includes, as a dispersoid, spherical carbonaceous particles which are obtained substantially from a solvent and a condensation product made by a methylene type bonding of an aromatic sulfonic acid or of a salt thereof, and further includes, as a dispersion medium, an electric insulating oil whose relative dielectric constant is 3 or more. Further, the electrorheological fluid of the present embodiment may include the modified silicone oil as occasion demands.

The dispersoid of the electrorheological fluid according to the present embodiment, that is, the spherical carbonaceous particles obtained substantially from a solvent and a condensation product made by a methylene type bonding of an aromatic sulfonic acid or a salt thereof will hereinafter be described in detail together with materials constituting the carbonaceous particles, a method for making the carbonaceous particles, and the like.

Examples of the above-described aromatic sulfonic acid or the salt thereof include naphthalene sulfonic acid, methyl naphthalene sulfonic acid, anthracene sulfonic acid, phenanthrene sulfonic acid, and include a product obtained by sulfonating a mixture of polycyclic aromatic compounds or a salt thereof, such as creosote oil, anthracene oil, tar, and pitch. These sulfonic acids can be easily obtained by sulfonation of their corresponding aromatic compounds by known methods. As an example of a cation which as a counter ion of an aromatic sulfonate, $NH_4^+$ can be presented. A very small amount of alkaline metal such as $Na^+$ or alkaline earth metal ions such as $Ca^{2+}$ can also be mixed therein.

The condensation product of aromatic sulfonic acids or a salt thereof can also be easily produced by known methods. Generally, aromatic sulfonic acids or salts thereof are condensed using formalin, paraformaldehyde, hexamethylene tetramine, or other aldehydes. Alternatively, the condensation product can be obtained by polymerization of an aromatic sulfonate having a vinyl group such as polystyrene sulfonic acid. Polymers of aromatic sulfonic acids having methylene type bonding may also be used.

As a group for linking aromatic sulfonic acids, a —$CH_2$— group is particularly preferable because manufacture thereof is simple and it can be easily obtained. A compound having a linking group represented by —$(CH_2)_n$—$T_x$—(CHR—)

m— (wherein T represents a benzene ring or a naphthalene ring, R represents hydrogen atom or a lower alkyl group or a benzene ring, and n, m, and x each represent integers of 0 or 1) can also be used. These condensation products can be a mixture of two or more kinds of condensation products or a copolymer thereof.

As a concrete example of a condensation product of aromatic sulfonic acids or a salt thereof, a formaldehyde condensation product of ammonium β-naphthalene sulfonate can be presented. The condensation product is a mixture of compounds ranging from monomeric units to condensation products of up to about 200 units. The average molecular weight is about 2,000 to 5,000.

This substance is solid at room temperatures and dissolves very little in a nonpolar solvent such as benzene, but dissolves at a low concentration in a polar organic solvent such as acetone and acetonitrile and dissolves easily in an aqueous solvent. The viscosity of a 40% by weight aqueous solution thereof at 20° C. is about several dozen to several 100 mPa·s. By changing the degree of condensation or the solution concentration of the condensation product and adjusting the viscosity to an appropriate value, the condensation products can be made spherical.

As a forming auxiliary agent for forming the condensation products in a spherical shape, various polymer compounds soluble or capable of being dispersed as a colloid in water or an aqueous solution can be used. For example, water-soluble polymer compounds including polyalkylene oxide compounds such as a condensation product of ethylene oxide and propylene oxide, or a condensation product of these oxides and alcohol, aliphatic acid, alkyl amine, and alkyl phenol; polyvinyl compounds such as polyvinyl alcohol and polyvinyl pyrrolidone; and polyacrylic acid compounds such as polyacrylic acid, polyacryl amide, and acrylic acid-acrylic amide copolymer can be used. Further, a surfactant or an antifoaming agent for decreasing the surface tension can be used together to facilitate the formation of the spherical shape. Alternatively, a dried and pulverized formaldehyde condensation product of ammonium β-naphthalene sulfonate can be used to adjust the viscosity to an appropriate degree. Aromatic sulfonic acids or polystyrene sulfonic acids formed as one type of condensation product of the salts of such aromatic sulfonic acids of the present embodiment, can also be used as a water-soluble polymer as a forming auxiliary agent.

A method for forming fine spherical particle bodies of a condensation product of aromatic sulfonic acids or a salt thereof is not particularly specified. For example, after dissolving a condensation product of aromatic sulfonic acids or a salt thereof in a solvent, fine spherical particle bodies can be formed by known methods such as the spray dry method and the precipitation method where an antisolvent is added.

Among the forming methods, the spray dry method is preferable as a method for forming fine spherical particle bodies of a condensation product of aromatic sulfonic acids or a salt thereof because this method reliably produces almost perfectly spherical particles with a small particle size using a simple production apparatus.

Preferable examples of the solvents used in the methods include: water; alcohols such as methanol; and polar solvents such as acetonitrile. In particular, aqueous solvents such as water and a mixture of water and another water-soluble solvent are preferable in terms of safety.

If an condensation product of a non-sulfonated aromatic compound derived from the unreacted material of the employed aromatic sulfonates is present, the quality of the resulting carbonaceous particles may not be satisfactory. Since such condensation product as an impurity is difficult to dissolve in water, such impurities can be eliminated easily with the use of an aqueous solvent.

The above-described spherical carbonaceous particles are carbonaceous particles that are almost perfectly spherical. Accordingly, the term "spherical" used in the present embodiment denotes that the particles, when observed under an electron microscope, are almost perfectly spherical. Preferably, both the deviation of the maximum diameter of a particle and the deviation of the minimum diameter of the particle are within 30% of the average diameter, and more preferably within 20%.

The bumpiness, i.e., divergence from the surface in a theoretical particle having an ideally smooth and perfectly spherical shape, is preferably 10% or less with respect to the average diameter, and more preferably 5% or less. Most preferably, the deviation of the maximum diameter of a particle and the deviation of the minimum diameter of the particle are each within 10% of the average diameter, and the bumpiness, i.e., divergence from the ideal spherical surface, is 3% or less with respect to the average diameter. The term "the average diameter" of one particle used herein refers to the average value of the maximum diameter and the minimum diameter of the particle.

As a method for producing spherical carbonaceous particles, there is generally used a method of carbonizing the above-described condensation product of aromatic sulfonic acids or a salt thereof formed in fine spherical particles by heat treatment in an inert gas atmosphere such as nitrogen and argon so as to maintain the spherical shape.

The carbonizing treatment conditions depend on the physical properties of the desired particle and the type of the material used for the particles. Usually, it is preferable to carry out the carbonizing treatment at a temperature in the range of 450 to 550° C. for 2 to 5 hours in an inert gas atmosphere. The inert gas is not particularly specified, but usually, nitrogen gas and rare gases such as argon, helium, and xenon are used. Among these, nitrogen gas and argon gas are preferable as they are easily obtainable.

The heat treatment temperature in the carbonizing treatment process must be set in the range of 400 to 600° C., and particularly preferable is the range of 450 to 550° C. The heat treatment may be conducted twice or more. At a temperature of 400° C. or less, sufficient electrorheological characteristics are difficult to obtain due to a significant amount of residual impurities such as S, O, and N in the obtained carbonaceous particles. At a temperature of 600° C. or more, the electrical resistance of the treated particles becomes low, and the power consumption increases due to the excessively large electric current flow. In the latter case there may also arise problems such as heat generation at the time of application of voltage. Therefore, neither is preferable.

In the carbonizing treatment of a condensation product of ammonium salt of aromatic sulfonic acids, sulfurous acid components and ammonium components are eliminated mainly in the range of 250 to 350° C. Accordingly, in order to prevent deterioration of strength which is caused by rapid elimination of volatile components, it is preferable to raise gently the temperature to the temperature range of 250 to 350° C., or to maintain this temperature range for a predetermined time.

Gases including sulfurous acid gas, steam, lower hydrocarbons, hydrogen sulfide, and hydrogen generated by the heat decomposition at the time of heat treatment of a condensation product of aromatic sulfonic acids or a salt thereof, and ammonium gas generated when an ammonium salt is used as the condensation product, contain impurities, and therefore, it is preferable to purge these gases with an inert gas.

As the above-described spherical carbonaceous particles, those containing carbon in a weight percentage of 80 to 97% are preferable, and those containing carbon in a weight percentage of 85 to 95% are particularly preferable. The C/H ratio (carbon/hydrogen atom ratio) of the carbonaceous particles is preferably 1.2 to 5, and 2 to 4 is particularly preferable.

It has been long known that the electrical resistance of the dispersoid of an electrorheological fluid is generally in a semiconductor domain (W. M. Winslow: J. Appl. Physics vol. 20, page 1137 (1949)); however, carbonaceous particles having less than 80% by weight of the carbon content and a C/H ratio of less than 1.2 are insulating materials, and thus, a liquid having an electrorheological effect can hardly be obtained therefrom. On the other hand, those having more than 97% by weight of the carbon content and a C/H ratio of more than 5 are like conductive materials and show an excessively large electric current when voltage is applied. A liquid having an electrorheological effect cannot be obtained in the latter case, either. The average particle size of the above-described spherical carbonaceous particles can be measured using a particle size measuring device (for example, a MICROTRAC SPA/MK-II type manufactured by Nikkiso Co., Ltd.) as mentioned in this embodiment. The average particle size of the spherical carbonaceous particles obtained after the carbonizing treatment is preferably about 0.1 to 20 $\mu$m, and more preferably 0.5 to 15 $\mu$m. If the average particle size is less than 0.1 $\mu$m, the initial viscosity of the electrorheological fluid obtained becomes high. On the other hand, if the average particle size is more than 20 $\mu$m, the dispersion stability of the particles deteriorates. Neither is preferable.

It is preferable that the above-described spherical carbonaceous particles have a collapsing strength (a pressure at which the particle collapse) of 5 kgf/mm$^2$ or more, and a maximum displacement amount of 3% or more. These can be measured using a micro-compression tester capable of measuring the strength of each particle (for example, MCTM series manufactured by Shimazu Corporation). If the collapsing strength is less than 5 kgf/mm$^2$, the strength of particles against breaking-up is insufficient, and durability lowers especially when shearing stress is repeatedly applied with use in a damper or the like. The preferable range of collapsing strength is 10 kgf/mm$^2$ or more.

The ash content of the spherical carbonaceous particles is preferably 0.1% or less. If the ash content is more than 0.1%, the amount of impurities increases, resulting in the poor electrorheological characteristics, which is not preferable. The ash content can be measured by an ordinary method.

The electrorheological fluid of the present embodiment can be obtained by dispersing the spherical carbonaceous particles obtained as described above in an electric insulating oil whose relative dielectric constant is 3 or more.

The spherical carbonaceous particles as the dispersoid are preferably contained in the electrorheological fluid in an amount of 1 to 60% by weight, more preferably 20 to 50% by weight. If the content is less than 1% by weight, the electrorheological effect is small, and on the other hand, if the content is more than 60% by weight, the initial viscosity when no voltage is applied becomes too high. Neither is preferable.

A detailed description will hereinafter be given of the electric insulating oil having a relative dielectric constant of 3 or more, which is a dispersion medium of the electrorheological fluid of the present embodiment.

The relative dielectric constant of the electric insulating oil used in the present embodiment is preferably 3 or more, and 3.5 or more is particularly preferable. If the relative dielectric constant is less than 3, a sufficient electrorheological effect (yield stress) cannot be obtained. If the relative dielectric constant is more than 10, a local electric field around dispersion particles (dispersoid) becomes conspicuously large and the apparent viscosity when voltage is applied varies. This is not preferable, either, as the electrorheological effect is not stably obtained.

In the present embodiment, the relative dielectric constant is the ratio of a dielectric constant of the electric insulating oil which is a dispersion medium, to a dielectric constant observed in a vacuum. The relative dielectric constant of the electric insulating oil is measured using, for example, an LE-22 type electrode for liquid samples manufactured by Ando Electric Co., Ltd. and a 1689 type impedance analyzer manufactured by GenRad Co.,. When the electric insulating oil is a mixed oil, an approximate value which would cause no problem in practice can be obtained by arithmetic average. Further, a dispersion medium does not include a modified silicone oil, which will be described later.

The electric insulating oil whose relative dielectric constant is 3 or more preferably has a kinematic viscosity at 25° C. of 1 to 100 mm$^2$/second, more preferably 1 to 50 mm$^2$/second, and most preferably 1 to 20 mm$^2$/second. By using a dispersion medium having a suitable kinematic viscosity, the above-described spherical carbonaceous particles as the dispersoid can be dispersed efficiently and stably. If the kinematic viscosity is more than 100 mm$^2$/second, the initial viscosity of the electrorheological fluid becomes too high and the change in viscosity caused by the electrorheological effect becomes small. Further, if the kinematic viscosity is less than 1 mm$^2$/second, the fluid is apt to volatilize and the stability of the dispersion medium may deteriorate.

As the electric insulating oil having a relative dielectric constant of 3 or more, a fluorosilicone oil whose specific gravity is greater than that of an ordinary silicone oil is preferably used because the fluorosilicone oil exhibits an excellent effect of inhibiting precipitation of spherical carbonaceous particles. However, a mixture of fluorosilicone oil and silicone oil can also be used suitably (this mixture is advantageous from the standpoint of cost reduction).

When a mixture of fluorosilicone oil and silicone oil is used as the electric insulating oil whose relative dielectric constant is 3 or more, the mixture ratio of the fluorosilicone oil to the silicone oil may be set arbitrarily so that the resulting electric insulating oil has a relative dielectric constant required for obtaining a desired electrorheological effect.

As the silicone oil as described above, a conventionally known silicone oil can be used. Concretely, commercially available silicone oils of TSF451-5, TSF451-10, TSF451-20, and TSF451-50, which are produced by Toshiba Silicone Co., Ltd. can be used. These can be used alone or in combinations of two or more.

Further, as the above-described electric insulating oil, a conventionally known electric insulating oil other than the silicone oil may also be used. For example, hydrocarbon oil, ester type oil, aromatic type oil, and the like can be listed. Concrete examples of such oils include aliphatic monocarboxylic acids such as: neocapric acid; aromatic monocarboxylic acids such as benzoic acid; aliphatic dicarboxylic acids such as adipic acid, glutaric acid, sebacic acid, and azelaic acid; aromatic dicarboxylic acids such as phthalic acid, isophthalic acid, and tetrahydrophthalic acid; and a mixture of the two or more kinds of these electric insulating oils, or a copolymer thereof.

The electric insulating oil preferably has a volume resistivity at 80° C. of $10^{11}\Omega\cdot$cm or more, and a value of $10^{13}\Omega\cdot$cm or more is particularly preferable.

As the above-described fluorosilicone oil particularly suitably used in the present embodiment, for example, an electric insulating oil composed of a siloxane polymer including a fluoroalkylmethylsiloxane unit, or a siloxane polymer including a dimethylsiloxane unit and a fluoroalkylmethylsiloxane unit can be listed.

Among these, the electric insulating oil composed of a siloxane polymer including a dimethylsiloxane unit and a fluoroalkylmethylsiloxane unit is preferable from the standpoint of being able to decrease the viscosity while maintaining high electric insulating properties. These fluorosilicone oils can be used alone or in combinations of two or more.

The above-described electric insulating oil composed of a siloxane polymer including a dimethylsiloxane unit and a fluoroalkylmethylsiloxane unit (which may hereinafter be referred to merely as a siloxane polymer) is an electric insulating oil composed of a polymer obtained by heat treatment of a siloxane polymer including dimethylsiloxane units of 0 to 90 mol % and fluoroalkylmethylsiloxane units of 10 to 100 mol %, or an electric insulating oil obtained by heat treatment of a mixture of the above-described siloxane polymer and liquid type dimethylpolysiloxane.

It is preferable that the number average molecular weight of the polymer contained in each of these electric insulating oils is 500 to 1,000, the degree of dispersion in molecular weight distribution is 1.05 to 1.25, and ionic impurities contained in the electric insulating oil are 5 ppm or less.

As the above-described siloxane polymer, a copolymer composed of dimethylsiloxane units of 0 to 90 mol %, preferably 40 to 80 mol %, and fluoroalkylmethylsiloxane units of 10 to 100 mol %, preferably 20 to 60 mol % is preferably used.

As a fluoroalkyl group included in the fluoroalkylmethylsiloxane unit, a group containing a perfluoroalkyl group, such as 3,3,3-trifluoropropyl group, 3,3,4,4,5,5,6,6,6-nonafluorohexyl group, and 3,3,4,4,5,5,6,6,7,7,8,8,9,9,10,10,10 -heptadecafluorodecyl group, is presented. Among these groups, 3,3,3-trifluoropropyl group is preferable from the viewpoint of allowing easy synthesis and having excellent properties.

When the above-described siloxane polymer is synthesized by a conventionally known method, if the ratio of the fluoroalkylmethylsiloxane units is more than 50 mol %, the siloxane polymer is apt to be influenced by water in the air so that the electric conductivity thereof increases. Such a siloxane polymer is not suitably used in practice. However, in the present embodiment, so long as the siloxane polymer is made to satisfy the above-described conditions as a result of the heat treatment, a homopolymer of fluoroalkylmethylsiloxane can also be appropriately used as the dispersion medium.

A method of synthesizing the above-described siloxane polymer will be described herein. Briefly, it suffices that the synthesis of the siloxane polymer be carried out using a known method. For example, a method for polymerizing, in the presence of an acid catalyst such as trifluoromethane sulfonic acid or activated clay, cyclic polysiloxane containing a fluoroalkyl group, hexamethyldisiloxane, and cyclic polyalkylsiloxane may be used (see Japanese Patent Publication (JP-B) Nos. 35-8345 and 47-47880).

When a fluorosilicone polymer used in the present embodiment is obtained, reaction at the time of polymerization is preferably carried out for at least two hours at 80° C., more preferably at 130° C. for two hours or more. After formation of the polymer, in order to achieve homogenization of the polymer to be obtained, it is preferable that agitation or stirring treatment is carried out for 12 hours or more.

Further, it is preferable that a monomer unit in the polymer to be obtained be randomized by performing sufficient stirring during reaction. If stirring is not sufficient, the dimethylsiloxane unit and a fluoroalkylmethylsiloxane unit each form its own aggregations (blocks) in the resulting copolymer, which is not preferable from the standpoint of stability and durability.

In order to obtain the above-described siloxane polymer, it is preferable that water be thoroughly removed from the materials and from a reactor. If water remains, there is a possibility of an end methyl group becoming a silanol group, and the presence of a silanol group may affect adversely the responsiveness of the electrorheological fluid. When the presence of the silanol group is found in the obtained polymer, an adverse influence on the responsiveness is avoided by changing the silanol group to the silyl group by a known treatment.

Further, as residual ions of a surfactant remaining in a reactor may increase the electric conductivity of an electric insulating oil, it is necessary to thoroughly wash the reactor.

In the present embodiment, an electric insulating oil is obtained by performing heat treatment of the above described siloxane polymer or of the mixture of the siloxane polymer and dimethylpolysiloxane. The heat treatment is preferably carried out at a temperature in the range of 80° C. to 160° C. for 30 minutes or more, more preferably one hour or more.

If the heating temperature is less than 80° C., volatile components included in the polymer cannot be sufficiently removed. On the other hand, if the heating temperature is more than 160° C., there is a possibility that a polymer molecule having reached desired physical properties may also volatilize. Therefore, neither extreme is preferable. The heat treatment is usually carried out in such a manner that after completion of polymerization reaction, the siloxane polymer or the mixture of the siloxane polymer and dimethylpolysiloxane is held in the reactor at 105° C. for one hour.

When the siloxane polymer including a fluoroalkylmethylsiloxane unit, and dimethylpolysiloxane (that is, a homopolymer of dimethylsiloxane) are used in a mixed manner, the ratio of the number of fluoroalkylmethylsiloxane units to the total number of dimethylsiloxane units included in the siloxane polymer and dimethylsiloxane units included in the dimethylpolysiloxane is preferably 0.1 or more.

The number average molecular weight of the siloxane polymer or dimethylpolysiloxane in the electric insulating oil obtained after the heat treatment is preferably 500 to 1,000. If it is less than 500, the resulting electric insulating oil will contain low molecular weight components at a high ratio which easily volatilize. On the other hand, if the number average MW is more than 1,000, the viscosity becomes too high. Therefore, neither case is preferable. Further, it is necessary that the degree of dispersion of molecular weight distribution be of 1.05 to 1.25, and preferably of 1.05 to 1.20. It is ideal that the degree of dispersion of molecular weight distribution becomes close to 1. However, the degree of dispersion is sufficiently industrially practicable (that is, achieves the purpose of the present invention) as long as it is maintained at 1.05 or thereabouts. On the other hand, if it is more than 1.25, the composition of the oil becomes nonuniform, which is not preferable. The number average molecular weight and molecular weight distribution of the polymer can be measured by ordinary methods.

The content of ionic impurities included in the above-described siloxane polymer is preferably 5 ppm or less. As described above, the ionic impurities mentioned herein are those that carry positive or negative charge when an electric current is applied thereto. For example, residual ions of a surfactant adherent to a reactor used in the synthesis of the siloxane polymer, or ionic impurities derived from a catalyst used for reaction, concretely, $Na^+$, $K^+$, $Cl^-$, $CH_3COO^-$, and the like can be listed. The ionic impurities content is preferably 0.1 ppm or less from the viewpoint of the electrorheological effect. In other words, when they are analyzed using atomic absorption spectroscopy or inductively coupled plasma (ICP) emission spectrometry, the content is preferably a detection limit or less. As a method for determining ionic impurities, there is presented a method of measuring mass spectrum using a mass spectroscopic analyzer or a mass spectrometer, such as inductively coupled plasma mass spectrometry (ICP-MS).

The above-described electric insulating oil preferably has a volume resistivity at 800° C. of $10^{11}\Omega\cdot m$ or more. A value of $10^{13}\Omega\cdot m$ or more is particularly preferable. Since the electric insulating oil having such volume resistivity as described above is composed of silicone oil containing a siloxane polymer, no deterioration occurs even if it is used in a state of directly contacting a rubber-type elastic material or each type of high-molecular materials, allowing the electric insulating oil to be preferably used for various applications. When the above-described electric insulating oil contains the ionic impurities at a level more than 5 ppm, there is a case in which it is difficult to obtain electric insulating properties with the volume resistivity at 80° C. of $10^{11}\Omega\cdot m$ or more, and therefore, special attention is required for this case.

The electric insulating oil whose relative dielectric constant is 3 or more, which is a dispersion medium of the present embodiment, is preferably contained in the electrorheological fluid in an amount of 99 to 40% by weight, and an amount of 80 to 45% by weight is more preferable. If the content is less than 40% by weight, the viscosity of the fluid when an electric field is not applied is apt to increase. If the content is more than 99% by weight, the electrorheological effect is apt to become small. Therefore, neither is preferable.

The powder particles for an electrorheological fluid according to the present embodiment, which include spherical carbonaceous particles and an electric insulating oil whose relative dielectric constant is 3 or more, has a yield stress of 3.4 to 4.0 kPa when an electric field of 4 kV/mm is applied.

The electrorheological fluid according to the present embodiment may contain modified silicone oil so as to further improve the dispersibility of the spherical carbonaceous particles as the dispersoid. This modified silicone oil will hereinafter be described in detail.

The above-described modified silicone oil is not particularly limited, and a modified silicone oil represented by the following general formula (1) is listed as an example. Specifically, amino-modified silicone oil having a combination of A and B shownin general formula (1), polyether-modified silicone oil, fluorine-modified silicone oil, phenol modified silicone oil, carbinol-modified silicone oil, methacryl-modified silicone oil, alkoxy-modified silicone oil, epoxy-modified silicone oil, and composite modified silicone oil thereof can be listed as examples the composite modified silicone oil is modified silicone oil having two or more groups selected from a group consisting of the amino group, the polyether group, the flourine group, the alkoxy group, and the epoxy group. These modified silicone oils can be used alone or in combinations of two or more. General formula (1):

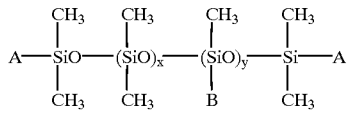

$1 \leq x \leq 1000$
$2 \leq y \leq 200$

TABLE 1

| | A | B |
|---|---|---|
| Amino-modified | $—R_1$<br>$—OR_1$ | $—Q_2NHQ_1N(R_2)_2$<br>$—Q_1N(R_2)_2$ |
| Phenol-modified | $—CH_3$ | 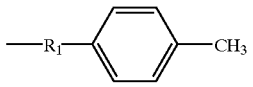 |
| Carbinol-modified | $—R_1OH$ | $—R_2OH$<br>$—CH_3$ |
| Methacryl-modified | | 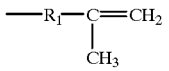 |
| Epoxy-modified | | 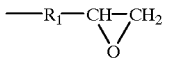 |
| Polyether-modified | | $—R_1C(C_2H_4O)_a(C_3H_6O)_bR_2$ |
| Fluorine-modified | | $—C_2H_4—CF_3$ |
| Alkoxy-modified | | $—OR_1$ |

In Table 1, $R_1$ and $R_2$ each indicate a hydrogen atom, a saturated hydrocarbon group, a hydrocarbon group including an alicyclic group, or a hydrocarbon group including an aromatic group. $Q_1$ and $Q_2$ each indicate an alkylene group. "a" indicates an integer of 0 to 50 and "b" indicates an integer of 0 to 50. In the case of amino-modified silicone oil, $R_1$ is particularly preferably a methyl group.

As the above-described modified silicone oil, preferably, one or more modified silicone oils selected from amino-modified silicone oil, polyether-modified silicone oil, and fluorine modified silicone oil, or composite modified silicone oil thereof are presented.

These modified silicone oils each have affinity with silicone oil and thereby function as a surfactant. As the modified silicone oils improve the dispersibility of the spherical carbonaceous particles as the dispersoid, precipitation of the spherical carbonaceous particles is prevented, re-dispersibility thereof is improved, and the initial viscosity of the liquid is reduced.

The above-described modified silicone oil is contained in the electrorheological fluid in an amount of 0.01 to 5% by weight, more preferably 0.01 to 3% by weight, and most preferably 0.01 to 2% by weight. If the contained amount is less than 0.01% by weight, an effect of adding the modified silicone oil is not sufficiently obtained. If the content is more than 5% by weight, an apparent viscosity when voltage is applied becomes unstable. Therefore, neither is preferable.

In the present embodiment, the above-described materials of the electrorheological fluid may be subjected to degassing treatment and a dielectric breakdown strength of 4.0 kV/mm or more can be obtained by the degassing treatment.

The above-described degassing treatment is carried out to prevent entrance of air or gases (nitrogen, oxygen, argon, and the like) that form air, into the electrorheological fluid. Concrete methods therefor will be described later. The quantity of the gas mixed into the electrorheological fluid is, first, approximately evaluated by observing the presence or absence of foaming when the electrorheological fluid is placed under a reduced pressure of 10 Pa. An absence of foaming indicates that almost no gas component is contained in the electrorheological fluid in a liquid state, and it is thought that, so long as the amount of the gas is such that no air bubbles are generated in the above-mentioned state, the gas being mixed in is not likely to cause reduction in dielectric breakdown strength. Accordingly, in the present invention, it is preferable that the degassing treatment be carried out to a level in which air bubbles are not generated under a reduced pressure of 10 Pa.

It should be noted that, among the gases to be mixed in, only gas having such physical properties as to cause electric discharge due to application of a high voltage when the gas is present in a bubble state are problematic, and therefore, no problem arises when gas without such physical properties is mixed in. Concretely, in the electrorheological fluid of the present embodiment, so long as 20 volume % or more of gas included in the electric insulating oil has a relatively large molecular weight and has a high dielectric breakdown strength, that is, has a large electron-attracting capacity and a dielectric breakdown strength of 4 kV/mm or more, no deterioration in the dielectric breakdown strength of the electrorheological fluid is caused. The dielectric breakdown strength of gas can be measured using ordinary methods.

Concrete examples of the gas that causes no reduction of the withstand voltage, that is, the gas whose dielectric breakdown strength is 4 kV/mm or more include those having a halogen atom, a cyano group, and a sulfone group in a molecule, such as $SF_6$ (electronegativity: 6.6 kV/mm), $CCl_2F_2$ (6.4 kV/mm), $C_3F_8$ (5.8 kV/mm), $C_2F_6$ (4.8 kV/mm), $C_5F_8$ (14.5 kV/mm), $CF_3CN$ (9.2 kV/mm), $C_2F_5CN$ (11.9 kV/mm), $Cl_2$ (4.1 kV/mm), $SOF_2$ (6.6 kV/mm), $C_2ClF_5$ (6.0 kV/mm), and $ClO_3F$ (7.2 kV/mm).

Next, a method for producing the electrorheological fluid of the present embodiment will be described.

The electrorheological fluid of the present invention is produced by degassing treatment of spherical carbonaceous particles, electric insulating oil, and modified silicone oil.

The degassing treatment is not particularly limited so long as mixing of air or gases (nitrogen, oxygen, argon, and the like) that form air, into the electrorheological fluid can be prevented. The degassing treatment is ordinarily carried out by stirring the spherical carbonaceous particles, the electric insulating oil, and the modified silicone oil under reduced pressure after they have been stirred and mixed under a normal pressure. Alternatively, the degassing treatment may be carried out by stirring and mixing the spherical carbonaceous particles, the electric insulating oil, and the modified silicone oil under the reduced pressure. In either case, mixing of gas into the electrorheological fluid can be prevented and the withstand voltage of the electrorheological fluid is remarkably improved.

In the present invention, the reduced pressure is 10 kPa (about 0.1 atmospheric pressure) or less, preferably 1,000 Pa or less, and more preferably 100 Pa or less. Concretely, in an airtight container, the pressure may be reduced using a vacuum pump or the like.

When the electrorheological fluid produced under the normal pressure is subjected to degassing under the reduced pressure, degassing is to be carried out for a predetermined time in a state in which a mixture obtained by stirring and mixing the spherical carbonaceous particles and the electric insulating oil whose relative dielectric constant is 3 or more is placed under the reduced pressure. In this case, it is preferable that the degassing be carried out while the mixture is being heated to a temperature of 40 to 80° C. and/or is being stirred. The condition of reduced pressure to be applied in this case is the same as that applied at the time of producing the electrorheological fluid under the reduced pressure.

As described above, the heating condition is a temperature preferably set in the range of 40° C. to 80° C. If it is less than 40° C., the viscosity of the fluid becomes too high and sufficient degassing may not be carried out. If it is more than 80° C., problems may occur in the stability of the electrorheological fluid.

The stirring in the degassing process can be carried out using an ordinary method. For example, rotatable mixing blades may be used or ultrasonic waves may be applied. In the case of using rotatable mixing blades, the rotational speed of the blades is preferably 10 to 200 rpm. In the application of ultrasonic waves, an output of 30 W or more is preferable.

When the above-mentioned electrorheological fluid (mixed under the reduced pressure or subjected to the degassing treatment) having a high dielectric breakdown strength is used or stored, if the electrorheological fluid is subjected to vibration in a container during shipping, for example, gas may be mixed again into the fluid so that the withstand voltage of the fluid decreases. As a solution, by filling a device or a storage container for accomodating the electrorheological fluid with a gas which is other than air and other that gases that form air and which has a large electron-attracting capacity and a high dielectric breakdown strength, even if the device is placed in an operating condition or the electrorheological fluid is placed in a state of being vibrated together with the storage container, the reduction in the withstand voltage of the electrorheological fluid due to the mixing of gas into the fluid can be prevented.

The gas having a high dielectric breakdown strength is, in general, a gas having a large electronegativity, and more specifically, a gas having a dielectric breakdown strength of 4.0 kV/mm or more and a large molecular weight. For example, $SF_6$, $CCl_2F_2$, $C_3F_8$, $C_2F_6$, $C_5F_8$, $CF_3CN$, $C_2F_5CN$, $Cl_2$, $SOF_2$, $C_2ClF_5$, $ClO_3F$, each having a halogen atom, or a cyano (CN) group, or a sulfone (SO) group in the molecule, are presented.

When shipping of the electrorheological fluid is conducted in such a manner as to be contained in a container loaded with such gas, high withstand voltage properties of the fluid at the time of production can be reliably maintained. Similarly, a device such as a damper used with the electrorheological fluid filled therein may be filled with such gas, so that reduction in the withstand voltage with the passage of time can be prevented and thus high reliability can be maintained for a long period of time.

EXAMPLES

The present embodiment will be explained in more detail with reference to concrete examples. However, the present invention is not limited to these examples.

Property Evaluation (1) Measurement of Particle Size:

The particle sizes of the spherical carbonaceous particles were measured using a MICROTRAC SPA/MK-II type device manufactured by Nikkiso Co., Ltd.

(2) Measurement of Electrorheological Effect (Yield Stress) and Initial Viscosity (Without Application of an Electric Field):

The shear stress of the electrorheological fluid when an electric field was not applied and the shear stress thereof when an electric field of 4 kV/mm was applied were measured using an RDS-II type rheometer manufactured by RHEOMETRICS Far East Co., Ltd. and a 610 type high voltage power supply manufactured by Trek. The initial viscosity of the fluid was obtained from the stress when an electric field was not applied and the yield stress was obtained from the difference between the stresses when an electric field was not applied and when the electric field of 4 kV/mm was applied.

(3) Measurement of Current Density:

The current density of the electrorheological fluid when an electric field of 4 kV/mm was applied was measured at room temperature (about 25° C.) using an RDS-II type rheometer manufactured by RHEOMETRICS Far East Co., Ltd. and a 610 type high voltage power supply manufactured by Trek.

(4) Measurement of Dielectric Breakdown Strength (Withstand Voltage):

The electric field strength was increased from 3.0 kV/mm by 0.1 kV/mm every 30 seconds at room temperature (about 25° C.) and at a shear rate of 1,000/second using an RDS-II type rheometer manufactured by RHEOMETRICS Far East Co., Ltd. and a 610 type high voltage power supply manufactured by Torek. Then, the electric field strength at which discharge occurred was set to be the dielectric breakdown strength (withstand voltage) of the electrorheological fluid.

In this case, a high voltage had already been applied for 10 minutes when the electric field strength reached, for example, 5.0 kV/mm, and therefore, it should be noted that the dielectric breakdown strength of the electrorheological fluid, which was obtained by the above method, is estimated at a value lower than an actual (inherent) dielectric breakdown strength of the materials (that it, the actual dielectric breakdown strength of the material is still higher than observed).

(5) Measurement of Viscosity of Sedimental Layer (Increase in Viscosity):

The initial viscosity (without application of an electric field) and the viscosity after being left standing for 4 weeks (without application of an electric field), of a bottom precipitated layer of the electrorheological fluid were measured with a digital viscometer using a T-bar spindle, and the increase in viscosity after being left standing for 4 weeks at room temperature (about 25° C.) was obtained.

Example 1

Preparation of Spherical Carbonaceous Particle Materials 1,050 g of sulfuric acid was added to 1,280 g of naphthalene, and the reaction was carried out at 160° C. for 2 hours. Unreacted materials were separated and discharged outside the container under a reduced pressure. Then, 857 g of 35% by weight concentration formalin was added and reacted at 105° C. for 5 hours to obtain a condensation product formed by methylene type bonding of β-naphthalene sulfonic acid. After being neutralized with ammonium water, the condensation product was filtrated to yield a filtrate liquid.

Water was added to the obtained filtrate liquid containing the condensation product formed by methylene type bonding of β-naphthalene sulfonic acid, to prepare a 20% by weight concentration aqueous solution of the methylene type bonding condensation product of ammonium p-naphthalene sulfonate.

The obtained aqueous solution was sprayed with a spray drier at an air pressure of 5 kg/cm$^2$ and was dried and granulated by introducing air for drying. The average particle size (50% volume average size) of the spherical carbonaceous particle material thus obtained of the methylene bonding type condensation product of sulfonic acid mainly comprising methyl naphthalene was 7.0 μm.

Preparation of Spherical Carbonaceous Particles

Partially carbonized spherical particles were obtained by preliminary heat treatment of the obtained carbonaceous particle material, at 400° C. in a nitrogen gas atmosphere. The carbon content (%), the carbon/hydrogen atom ratio (hereinafter referred to as C/H ratio), and the average particle size (μm) of the particles were 90.8%, 2.0, and 7.0 μm, respectively. The spherical particles for the electrorheological fluid were obtained by heating the partially carbonized spherical particles for 4 hours at 530° C. in a nitrogen gas atmosphere (carbonizing treatment), by pulverizing the particles and then by eliminating unwanted particles having an irregular (non-spherical) figure. The carbon content (%), the C/H ratio, and the average particle size (μm) of the resulting particles were 93.6%, 2.4, and 6 μm, respectively.

Preparation of Electrorheological Fluid

45% by weight of the spherical carbonaceous particles and 55% by weight of a fluorosilicone oil having a kinematic viscosity at 25° C. of 8 mm$^2$/second and a relative dielectric constant of 5.0 (the fluorosilicone oil was an electric insulating oil composed of a siloxane polymer including 60 mol % of dimethylsiloxane units and 40 mol % of fluoroalkylmethylsiloxane units) were stirred under a reduced pressure of 10 Pa, to obtain an electrorheological fluid of Example 1.

Evaluations

As the result of measurement of the withstand voltage of the obtained electrorheological fluid of Example 1, it was seen that no discharge occurred at 5.0 kV/mm and that the withstand voltage was 5.0 kV/mm or more. The viscosity of the electrorheological fluid without application of an electric field was 200 mPa·s, the yield stress thereof when an electric field of 4 kV/mm was applied was 4.0 kPa, and the electric current density thereof when an electric field of 4 kV/mm was applied was 20 μA/cm$^2$. Further, the viscosity (torque) of a sedimental layer measured after the electrorheological fluid was left standing for 4 weeks was 8 $\mu$N·m, which was greater than the initial torque (6 $\mu$N·m) by about 30%.

Example 2

Under the same conditions as Example 1 except that 0.5% by weight of fluorine amino modified silicone oil was further added in the preparation of the electrorheological fluid of Example 1, an electrorheological fluid of Example 2 was obtained.

Evaluations

The electrorheological fluid obtained in Example 2 had a viscosity without application of an electric field of 180 mPa·s, which was lower than that of the electrorheological fluid of Example 1 by about 10%. Further, the viscosity of a precipitated layer (torque) measured after the electrorheological fluid was left standing for 4 weeks was 7 $\mu$N·m, which was greater than the initial torque (6 $\mu$N·m) by about 15%. Other measured values, that is, the withstand voltage, the yield stress, and the electric current density when an electric field of 4 kV/mm was applied were evaluated as in Example 1.

Example 3

48% by weight of the spherical carbonaceous particles used in Example 1 and 52% by weight of a mixture of a fluorosilicone oil having a kinematic viscosity at 25° C. of 7.5 $mm^2$/second and a relative dielectric constant of 3.8 (the fluorosilicone oil was an electric insulating oil composed of a siloxane polymer including 60 mol % of dimethylsiloxane units and 40 mol % of fluoroalkylmethylsiloxane units) and a dimethylsilicone oil (a mixture of "TSF451-5" and "TSF451-10" produced by Toshiba Silicone Co., Ltd. at a ratio of 1:1), the fluorosilicone oil and the dimethylsilicone oil being mixed at a ratio of 1:1, were stirred under a reduced pressure of 10 Pa, to obtain an electrorheological fluid of Example 3.

Evaluations

As the result of measurement of the withstand voltage of the obtained electrorheological fluid of Example 3, it was seen that no discharge occurred at 5.0 kV/mm and that the withstand voltage was 5.0 kV/mm or more. The viscosity of the electrorheological fluid without application of an electric field was 200 mPa·s, the yield stress thereof when an electric field of 4 kV/mm was applied was 3.4 kPa, and the electric current density thereof when an electric field of 4 kV/mm was applied was 18 $\mu A/cm^2$. Further, the viscosity of a precipitated layer (torque) measured after the electrorheological fluid was left standing for 4 weeks was 9 $\mu$N·m, which was greater than the initial torque (6 $\mu$N·m) by about 50%.

Example 4

Under the same conditions as Example 1 except that, in the preparation of the spherical carbonaceous particle materials in Example 1, the average particle size after spray drying was changed to 4 $\mu$m, and in the preparation of the spherical carbonaceous particles in Example 1, the carbon content after preliminary heat treatment was changed to 92.6%, the C/H ratio was changed to 2.0, the average particle size was changed to 4 $\mu$m, and the temperature at the carbonizing treatment was changed to 520° C., the carbon content after the carbonizing treatment was changed to 94.5%, the C/H ratio was changed to 2.4, and the average particle size was changed to 3 $\mu$m, spherical carbonaceous particles were obtained.

42% by weight of the spherical carbonaceous particles thus obtained and 58% by weight of a fluorosilicone oil having a kinematic viscosity at 25° C. of 8 $mm^2$/second and a relative dielectric constant of 5.0 (the fluorosilicone oil was an electric insulating oil composed of a siloxane polymer including 60 mol % of dimethylsiloxane units and 40 mol % of fluoroalkylmethylsiloxane units) were stirred at a reduced pressure of 10 Pa, to obtain an electrorheological fluid of Example 4.

Evaluations

As the result of measurement of the withstand voltage of the obtained electrorheological fluid of Example 4, it was seen that no discharge occurred at 5.0 kV/mm and that the withstand voltage was 5.0 kV/mm or more. The viscosity of the electrorheological fluid without application of an electric field was 200 mPa·s, the yield stress thereof when an electric field of 4 kV/mm was applied was 3.4 kPa, and the electric current density thereof when an electric field of 4 kV/mm was applied was 20 $\mu A/cm^2$.

Further, the viscosity of a precipitated layer (torque) measured after the electrorheological fluid was left standing for 4 weeks was 8 $\mu$N·m, which was greater than the initial torque (6 $\mu$N·m) by about 30%.

Comparative Example 1

48% by weight of the spherical carbonaceous particles used in Example 1 and 52% by weight of a silicone oil having a kinematic viscosity at 25° C. of 7 $mm^2$/second and a relative dielectric constant of 2.6 (the silicone oil was a dimethyl silicone oil as s a mixture of "TSF451-5" and "TSF451-10" produced by Toshiba Silicone Co., Ltd., at a ratio of 1:1) were stirred under atmospheric conditions, to obtain an electrorheological fluid of Comparative Example 1.

Evaluations

As the result of measurement of the withstand voltage of the obtained electrorheological fluid of Comparative Example 1, it was seen that no discharge occurred at 5.0 kV/mm and that the withstand voltage was 5.0 kV/mm or more. The viscosity of the electrorheological fluid without application of an electric field was 200 mPa·s, the yield stress thereof when an electric field of 4 kV/mm was applied was 2.5 kPa, and the electric current density thereof when an electric field of 4 kV/mm was applied was 17 $\mu A/cm^2$.

Further, the viscosity of a precipitated layer (torque) measured after the electrorheological fluid was left standing for 4 weeks was 12 $\mu$N·m, which was greater than the initial torque (6 $\mu$N·m) by about 100%.

Comparative Example 2

45% by weight of the spherical carbonaceous particles used in Example 3 and 55% by weight of a silicone oil having a kinematic viscosity at 25° C. of 7 $mm^2$/second and a relative dielectric constant of 2.6 (the silicone oil was a dimethylsilicone oil as a mixture of "TSF451-5" and "TSF451-10" produced by Toshiba Silicone Co., Ltd., at a ratio of 1:1) were stirred under atmospheric conditions, to obtain an electrorheological fluid of Comparative Example 2.

Evaluations

As the result of measurement of the withstand voltage of the obtained electrorheological fluid of Comparative Example 2, it was seen that no discharge occurred at 5.0 kV/mm and that the withstand voltage was 5.0 kV/mm or more. The viscosity of the electrorheological fluid without application of an electric field was 200 mPa·s, the yield stress thereof when an electric field of 4 kV/mm was applied was 2.1 kPa, and the electric current density thereof when an electric field of 4 kV/mm was applied was 17 $\mu A/cm^2$.

Further, the viscosity of a precipitated layer (torque) measured after the electrorheological fluid was left standing for 4 weeks was 10 $\mu$N·m, which was greater than the initial torque (6 $\mu$N·m) by about 70%.

The above-described results are shown in Table 2.

TABLE 2

| | | Ex. 1 | Ex. 2 | Ex. 3 | Ex. 4 | Com. Ex. 1 | Com. Ex. 2 |
|---|---|---|---|---|---|---|---|
| Viscosity (mPa · s) (with no electric field applied) | | 200 | 180 | 200 | 200 | 200 | 200 |
| Yield stress (kPa) | | 4.0 | 4.0 | 3.4 | 3.4 | 2.5 | 2.1 |
| Current density ($\mu A/cm^2$) | | 20 | 20 | 18 | 20 | 17 | 17 |
| Dielectric breakdown strength (kV/mm) | | 5.0 | 5.0 | 5.0 | 5.0 | 5.0 | 5.0 |
| Viscosity of precipitated layer | Initial viscosity ($\mu$N · m) | 6 | 6 | 6 | 6 | 6 | 6 |
| | after 4 weeks ($\mu$N · m) | 8 | 7 | 9 | 8 | 12 | 10 |
| | Rate of increase (%) | 30 | 15 | 50 | 30 | 100 | 70 |
| Type of electric insulating oil | | ① | ① | ② | ① | ③ | ③ |
| Relative dielectric constant | | 5.0 | 5.0 | 3.8 | 5.0 | 2.6 | 2.6 |
| Kinematic viscosity | | 8 | 8 | 7.5 | 8 | 7 | 7 |
| Addition of modified silicone oil | | no | yes | no | no | no | no |

Notes:
"Ex." and "Comp. Ex.."mean Example and Comparative Example, respectively.
① means fluorosilicone oil.
② means a mixture of fluorosilicone oil and dimethylsilicone oil.
③ means dimethylsilicone oil.

As can be seen from the results of Table 2, the electrorheological fluids of Examples 1 to 3, each comprising spherical carbonaceous particles and an electric insulating oil whose relative dielectric constant is 3 or more (that is, a fluorosilicone oil), each exhibit a high yield stress of 3 to 4 kPa when an electric field of 4 kV/mm was applied, maintain a high dielectric breakdown strength, and show that the change of localized viscosity caused by precipitation of the spherical carbonaceous particles is small even when the fluid is left standing for a long time. Accordingly, it can be seen that the dispersibility of the particles is excellent and that the particles are uniformly distributed throughout the entire electrorheological fluid. Further, it can also be seen that the viscosity without application of an electric field of the electrorheological fluid of Example 2 with a modified silicone oil added thereto is maintained at a low value.

In the present embodiment, the following series of experiments were conducted in order to verify effects obtained by the degassing treatment.

Example 5

Preparation of the Spherical Carbonaceous Particle Materials

The spherical carbonaceous particle material having average particle size (50% volume average size) of 7.0 $\mu$m was produced using the methylene bonding type condensation product of sulfonic acid mainly comprising methyl naphthalene in the same manner as Example 1.

Preparation of Spherical Carbonaceous Particles

Partially carbonized spherical particles and then spherical carbonaceous particles were obtained in the same manner as Example 1. The carbon content (%), the C/H ratio, and the average particle size ($\mu$m) of the resulting particles were 93.6%, 2.4, and 6 $\mu$m, respectively.

Preparation of Electrorheological Fluid

48% by weight of the spherical carbonaceous particles, 52% by weight of a silicone oil having a kinematic viscosity at 25° C. of 7 $mm^2$/second (the silicone oil was a dimethylsilicone oil as a mixture of "TSF451-5" and "TSF451-10" produced by Toshiba Silicone Co., Ltd., at a ratio of 1:1), and 0.3% by weight of polyether-modified silicone were stirred and mixed under atmospheric conditions, and thereafter, were subjected to ultrasonic treatment for 15 minutes under a reduced pressure of 10 Pa, to obtain an electrorheological fluid of Example 5.

Evaluations

As the result of measurement of the withstand voltage of the obtained electrorheological fluid of Example 5, it was seen that no discharge occurred at 4.5 kV/mm and that the withstand voltage was 4.5 kV/mm or more. The viscosity of the electrorheological fluid without application of an electric field was 120 mPa·s, the yield stress thereof when an electric field of 4 kV/mm was applied was 2.9 kPa, and the electric current density thereof when an electric field of 4 kV/mm was applied was 19 $\mu A/cm^2$.

Example 6

52% by weight of the spherical carbonaceous particles used in Example 5, 48% by weight of a silicone oil having a kinematic viscosity at 25° C. of 7 $mm^2$/second (the silicone oil was a dimethylsilicone oil as a mixture of "TSF451-5" and "TSF451-10" produced by Toshiba Silicone Co., Ltd., at a ratio of 1:1), and 0.3% by weight of polyether-modified silicone were stirred and mixed under atmospheric conditions, and thereafter, were subjected to ultrasonic treatment for 15 minutes under a reduced pressure of 10 Pa, to obtain an electrorheological fluid of Example 6.

Evaluations

As the result of measurement of the withstand voltage of the obtained electrorheological fluid of Example 6, it was seen that no discharge occurred at 4.5 kV/mm and that the withstand voltage was 4.5 kV/mm or more. The viscosity of the electrorheological fluid without application of an electric field was 200 mPa·s, the yield stress thereof when an electric field of 4 kV/mm was applied was 3.7 kPa, and the electric current density thereof when an electric field of 4 kV/mm was applied was 20 $\mu A/cm^2$.

Example 7

Under the same conditions as Example 5 except that, in the preparation of the spherical carbonaceous particle materials in Example 5, the average particle size after spray drying was changed to 4 $\mu$m, and in the preparation of the spherical carbonaceous particles in Example 5, the carbon content after preliminary heating treatment was changed to 92.6%, the C/H ratio was changed to 2.0, the average particle size was changed to 4 μm, and the temperature at carbonizing treatment was changed to 520° C., the carbon content after the carbonizing treatment was changed to 94.5%, the C/H ratio was changed to 2.4, and the average particle size was changed to 3 μm, spherical carbonaceous particles were obtained.

45% by weight of the spherical carbonaceous particles thus obtained, 55% by weight of a silicone oil having a kinematic viscosity at 25° C. of 7 $mm^2$/second (the silicone oil was a dimethylsilicone oil as a mixture of "TSF451-5" and "TSF451-10" produced by Toshiba Silicone Co., Ltd., at a ratio of 1:1), and 0.3% by weight of polyether-modified silicone were stirred and mixed under atmospheric conditions, and thereafter, were subjected to ultrasonic treatment for 15 minutes at a reduced pressure of 10 Pa, to obtain an electrorheological fluid of Example 7.

Evaluations

As the result of measurement of the withstand voltage of the obtained electrorheological fluid of Example 7, it was seen that no discharge occurs at 4.5 kV/mm and that the withstand voltage was 4.5 kV/mm or more. The viscosity of the electrorheological fluid without application of an electric field was 130 mPa·s, the yield stress thereof when an electric field of 4 kV/mm was applied was 2.5 kPa, and the electric current density thereof when an electric field of 4 kV/mm was applied was 19 μA/$cm^2$.

Example 8

49% by weight of the spherical carbonaceous particles used in Example 7, 51% by weight of a silicone oil having a kinematic viscosity at 25° C. of 7 $mm^2$/second (the silicone oil was a dimethylsilicone oil as amixture of "TSF451-5" and "TSF451-10" produced by Toshiba Silicone Co., Ltd., at a ratio of 1:1), and 0.3% by weight of polyether-modified silicone were stirred and mixed under atmospheric conditions, and thereafter, were subjected to ultrasonic treatment for 15 minutes at a reduced pressure of 10 Pa, to obtain an electrorheological fluid of Example 8.

Evaluations

As the result of measurement of the withstand voltage of the obtained electrorheological fluid of Example 8, it was seen that no discharge occurred at 4.5 kV/mm and that the withstand voltage was 4.5 kV/mm or more. The viscosity of the electrorheological fluid without application of an electric field was 200 mPa·s, the yield stress thereof when an electric field of 4 kV/mm was applied was 3.2 kPa, and the electric current density thereof when an electric field of 4 kV/mm was applied was 20 μA/$cm^2$.

Comparative Example 3

48% by weight of the spherical carbonaceous particles used in Example 5, 52% by weight of a silicone oil having a kinematic viscosity at 25° C. of 7 $mm^2$/second (the silicone oil was a dimethylsilicone oil as a mixture of "TSF451-5" and "TSF451-10" produced by Toshiba Silicone Co., Ltd., produced by Toshiba Silicone Co., Ltd., at a ratio of 1:1), and 0.3% by weight of polyether-modified silicone were stirred and mixed under atmospheric conditions, to obtain an electrorheological fluid of Comparative Example 3.

Evaluations

As the result of measurement of the withstand voltage of the obtained electrorheological fluid of Comparative Example 3, it was seen that discharge occurred with 3.6 kV/mm and that the withstand voltage was 3.6 kV/mm. The viscosity of the electrorheological fluid without application of an electric field was 120 mPa·s, the yield stress thereof when an electric field of 4 kV/mm was applied was 2.9 kPa, and the electric current density thereof when an electric field of 4 kV/mm was applied was 19 μA/$cm^2$.

Comparative Example 4

45% by weight of the spherical carbonaceous particles used in Example 7, 55% by weight of a silicone oil having a kinematic viscosity at 25° C. of 7 $mm^2$/second (the silicone oil was a dimethylsilicone oil as amixture of "TSF451-5" and "TSF451-10" produced by Toshiba Silicone Co., Ltd., at a ratio of 1:1), and 0.3% by weight of polyether-modified silicone were stirred and mixed under atmospheric conditions, to obtain an electrorheological fluid of Comparative Example 4.

Evaluations

As the result of measurement of the withstand voltage of the obtained electrorheological fluid of Comparative Example 4, it was seen that discharge occurred at 3.6 kV/mm and that the withstand voltage was 3.6 kV/mm. The viscosity of the electrorheological fluid without application of an electric field was 130 mPa·s, the yield stress thereof when an electric field of 4 kV/mm was applied was 2.5 kPa, and the electric current density thereof when an electric field of 4 kV/mm was applied was 19 μA/$cm^2$.

Comparative Example 5

An electrorheological fluid of Comparative Example 5 was obtained in the same way as Comparative Example 3 except that no polyether-modified silicone was added.

Evaluations

As the result of measurement of the withstand voltage of the obtained electrorheological fluid of Comparative Example 5, it was seen that no discharge occurred at 4.5 kV/mm and that the withstand voltage was 4.5 kV/mm or more. The viscosity of the electrorheological fluid without application of an electric field was 200 mPa·s, the yield stress thereof when an electric field of 4 kV/mm was applied was 2.5 kPa, and the electric current density thereof when an electric field of 4 kV/mm was applied was 17 μA/$cm^2$.

Comparative Example 6

An electrorheological fluid of Comparative Example 6 was obtained in the same way as Comparative Example 4 except that no polyether-modified silicone was added.

Evaluations

As the result of measurement of the withstand voltage of the obtained electrorheological fluid of Comparative Example 6, it was seen that no discharge occurred at 4.5 kV/mm and that the withstand voltage was 4.5 kV/mm or more. The viscosity of the electrorheological fluid without application of an electric field was 200 mpa-s, the yield stress thereof when an electric field of 4 kV/mm was applied was 2.1 kPa, and the electric current density thereof when an electric field of 4 kV/mm was applied was 17 μA/$cm^2$.

The above-described results are shown in Table 3.

TABLE 3

| | Ex. 5 | Ex. 6 | Ex. 7 | Ex. 8 |
|---|---|---|---|---|
| Viscosity (mPa · s) | 120 | 200 | 130 | 200 |
| Yield stress (kPa) | 2.9 | 3.7 | 2.5 | 3.2 |
| Current density ($\mu$A/cm$^2$) | 19 | 20 | 19 | 20 |
| Dielectric breakdown strength (kV/mm) | 4.5 | 4.5 | 4.5 | 4.5 |
| Modified silicone oil | yes | yes | yes | yes |
| Degassing treatment | yes | yes | yes | yes |
| | Com. Ex. 3 | Com. Ex. 4 | Com. Ex. 5 | Com. Ex. 6 |
| Viscosity (mPa · s) | 120 | 130 | 200 | 200 |
| Yield stress (kpa) | 2.9 | 2.5 | 2.5 | 2.1 |
| Current density ($\mu$A/cm$^2$) | 19 | 19 | 17 | 17 |
| Dielectric breakdown strength (kV/mm) | 3.6 | 3.6 | 4.5 | 4.5 |
| Modified silicone oil | yes | yes | no | no |
| Degassing treatment | no | no | no | no |

Note: "Ex." and "Comp. Ex.." mean Example and Comparative Example, respectively.

It can be seen from the results of Table 3 that, as compared with electrorheological fluids of Comparative Examples 5 and 6, electrorheological fluids of Comparative Examples 3 and 4 each show that the electrorheological effect somehow improves with the addition of the modified silicone oil, but the dielectric breakdown strength conspicuously decrease. On the other hand, it can be seen that electrorheological fluids of Examples 5 to 7, which have been subjected to the degassing treatment after the spherical carbonaceous particles, the electric insulating oil, and the modified silicone oil were stirred and mixed, each obtain a high electrorheological effect while maintaining a high withstand voltage.

In summary, the present embodiment is provided based mainly on the fact that the relative dielectric constant of an electric insulating oil which is a dispersion medium has a great influence on the electrorheological effect, and particularly base on the fact that a high electrorheological effect is obtained irrespective of the kind of dispersion medium so long as the relative dielectric constant is 3 or more. The electrorheological fluid of the present embodiment includes the spherical carbonaceous particles and the electric insulating oil whose relative dielectric constant is 3 or more, and when an electric field of 4 kV/mm was applied, a yield stress of 3.4 to 4.0 kPa was obtained. As a result, it was demonstrated that the electrorheological fluid according to the present embodiment exhibits sufficient vibration damping effects when it is used in a high performance ER device (for example, a shock absorber used by a mobile equipment or a firearm, a clutch, and a damper of a large-size apparatus).

Further, in the present embodiment, as the electric insulating oil having a relative dielectric constant of 3 or more, fluorosilicone oil or a mixture of fluorosilicone oil and silicone oil is used. The difference in specific gravity between the fluorosilicone oil (about 1.1) and the spherical carbonaceous particles (about 1.4) is smaller than that between the silicone oil (about 0.9) and the spherical carbonaceous particles (about 1.4), and therefore, in the case of using the fluorosilicone oil, precipitation of the particles in the electrorheological fluid is significantly inhibited.

Moreover, in the present embodiment, the viscosity without application of an electric field decreases with the further addition of the modified silicone oil, and the precipitation of the particles in the electrorheological fluid can be inhibited still further. As a result, even when the fluid is left standing for a long time, a high-density precipitated layer is not formed, and an electrorheological fluid having excellent re-dispersibility can be obtained.

Further, in the present embodiment, an electrorheological fluid having a dielectric breakdown strength of 4 kV/mm or more is reliably obtained by stirring and mixing the spherical carbonaceous particles and the electric insulating oil whose relative dielectric constant is 3 or more under a reduced pressure or by carrying out the degassing treatment using ultrasonic treatment or the like under a reduced pressure after mixing the components under atmospheric conditions.

That is, since the above-described particles having high strength are used, powder particles for an electrorheological fluid which can be used stably (the dielectric breakdown strength of the particles is maintained at a high value), have excellent durability, demonstrate little change in the viscosity of the fluid with the passage of time, and further have a high electrorheological effect (yield stress) under the application of voltage can be provided.

What is claimed is:

1. An electrorheological fluid comprising:

carbonaceous particles of a spherical form, obtained substantially from a solvent and a condensation product formed by a methylene type bonding of an aromatic sulfonic acid or a salt of said aromatic sulfonic acid as materials; and an electric insulating oil, having:

a relative dielectric constant of 3 or more;

a kinematic viscosity at 25° C. of 1 to 100 mm$^2$/second; and wherein the electric insulating oil is any one of fluorosilicone oil and a mixture of fluorosilicone oil and silicone oil.

2. An electrorheological fluid according to claim 1, wherein the sperical form has a deviation of the maximum diameter and a deviation of the minimum diameter of the carbonaceous particles each within 30% of the average diameter, and the average particle size of the carbonaceous particles is of 0.1 to 20 $\mu$m.

3. An electrorheological fluid according to claim 1, wherein the fluorosilicone oil is an electric insulating oil comprised of a siloxane polymer including 0 to 90 mol % of dimethylsiloxane units and 10 to 100 mol % of fluoroalkylmethylsiloxane units.

4. An electrorheological fluid according to claim 1, further comprising modified silicone oil at a weight percentage of 0.01 to 5%.

5. An electrorheological fluid according to claim 3, further comprising modified silicone oil at a weight percentage of 0.01 to 5%.

6. An electrorheological fluid according to claim 4, wherein the modified silicone oil is one or more modified silicone oils selected from a group consisting of an amino-modified silicone oil, a polyether-modified silicone oil, a fluorine-modified silicone oil, an alkoxy-modified silicone oil, and an epoxy-modified silicone oil, or is a composite modified silicone oil, said composite modified silicone oil being a modified silicone oil having two or more groups selected from a group consisting of the amino group, the polyether group, the fluorine group, the alkoxy group, and the epoxy group.

7. An electrorheological fluid according to claim 5, wherein the modified silicone oil is one or more modified silicone oils selected from a group consisting of an amino-modified silicone oil, a polyether-modified silicone oil, a fluorine-modified silicone oil, an alkoxy-modified silicone oil, and an epoxy-modified silicone oil, or is a composite modified silicone oil, said composite modified silicone oil being a modified silicone oil having two or more groups selected from a group consisting of the amino group, the polyether group, the fluorine group, the alkoxy group, and the epoxy group.

8. An electrorheological fluid according to claim 1, wherein a dielectric breakdown strength of the electrorheological fluid is 4.0 kV/mm or more.

9. An electrorheological fluid according to claim 1, wherein when a voltage of 4 kV/mm is applied, a yield stress of 3.2 kPa or more is generated.

10. An electrorheological fluid according to claim 1, wherein when the carbonaceous particles of a spherical form and the electric insulating oil are mixed under a reduced pressure, a dielectric breakdown strength of the electrorheological fluid becomes 4 kV/mm or more.

11. An electrorheological fluid according to claim 1, wherein by mixing the carbonaceous particles of a spherical form and the electric insulating oil under a normal pressure and thereafter removing air or gases that form air from an obtained electrorheological fluid under a reduced pressure, a dielectric breakdown strength of the electrorheological fluid becomes 4 kV/mm or more.

* * * * *